US006666235B2

(12) United States Patent
Chi et al.

(10) Patent No.: US 6,666,235 B2
(45) Date of Patent: Dec. 23, 2003

(54) LIGHTWEIGHT DENIM FABRIC CONTAINING HIGH STRENGTH FIBERS AND CLOTHING FORMED THEREFROM

(75) Inventors: Cheng-Hang Chi, Midlothian, VA (US); Larry John Prickett, Chesterfield, VA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 83 days.

(21) Appl. No.: 10/044,269

(22) Filed: Oct. 26, 2001

(65) Prior Publication Data

US 2003/0098068 A1 May 29, 2003

(51) Int. Cl.[7] ..... D03D 13/00

(52) U.S. Cl. ..... 139/420 A; 2/2.5; 442/203; 139/420 R

(58) Field of Search ..... 2/2.5; 442/203; 139/420 R

(56) References Cited

U.S. PATENT DOCUMENTS

| | | | | | |
|---|---|---|---|---|---|
| 3,803,453 | A | | 4/1974 | Hull | |
| 4,612,150 | A | | 9/1986 | De Howitt | |
| 4,900,613 | A | | 2/1990 | Green | |
| 4,941,884 | A | | 7/1990 | Green | |
| 4,961,306 | A | | 10/1990 | Sawhney et al. | |
| 5,025,537 | A | | 6/1991 | Green | |
| 5,050,406 | A | | 9/1991 | Strauss et al. | |
| 5,077,126 | A | | 12/1991 | Green | |
| 5,119,644 | A | | 6/1992 | Strauss et al. | |
| 5,223,334 | A | | 6/1993 | Green | |
| 5,628,172 | A | | 5/1997 | Kolmes et al. | |
| 5,634,215 | A | * | 6/1997 | DeBaene | 2/227 |
| 5,891,813 | A | * | 4/1999 | Gadoury | 442/169 |
| 5,918,319 | A | * | 7/1999 | Baxter | 2/455 |
| 6,057,032 | A | | 5/2000 | Green | |
| 6,497,951 | B1 | * | 12/2002 | DeAngelis et al. | 428/364 |
| 6,534,426 | B1 | * | 3/2003 | Chiou | 442/203 |

* cited by examiner

*Primary Examiner*—A. Vanatta
*Assistant Examiner*—Robert H. Muromoto, Jr.

(57) ABSTRACT

A lightweight and durable high-performance denim fabric. More particularly, a lightweight durable denim comprising a high strength component and a natural fiber, which is constructed into a fabric having both about a 15% lighter weight and about 15% higher durability than standard denim.

19 Claims, No Drawings

LIGHTWEIGHT DENIM FABRIC CONTAINING HIGH STRENGTH FIBERS AND CLOTHING FORMED THEREFROM

FIELD OF THE INVENTION

The present invention relates to a lightweight and durable high-performance denim fabric. More particularly, the present invention relates to a lightweight durable denim comprising at least one high-performance high strength fiber and a natural fiber component, wherein these are used to ultimately construct a fabric having at least a 15% lighter weight and at least a 15% higher durability than standard denim.

BACKGROUND OF THE INVENTION

Denim fabrics are well known and typical commercially available denim varies according to its particular application, such as its use in various types of garments or apparel. However, typical commercially available denim does not possess the requisite properties allowing it to be comfortably worn on a daily basis while retaining sufficient tear and breaking strength.

With regard to denim or any given fabric, comfort is generally dependent upon three variables, namely, fiber type, fabric weight and fabric construction, while fabric strength or durability can be described by tear strength and breaking strength, both of which are vital for denim fabric that undergoes daily use. Proper balancing of these variables is critical. Attempts to manufacture lightweight cotton denim have proven unsuccessful because the lighter weight was obtained by utilizing a thinner or lighter fabric made from cotton having a loose weave. The desirable properties such as durability and strength were compromised, thereby resulting in a less wearable garment because the material would prematurely deteriorate or disintegrate due to daily use and/or laundering. Fabrics constructed having a looser weave, allow for greater moisture transport as well as flexibility, however such fabrics result in poor performance and lower strength.

Generally, it is well known in the art that the enhancement of properties of a denim fabric can occur by including aramid fibers in the fabric. For example Kevlar®, an aramid fiber, is a high modulus fiber that is known for its high strength, but is also well known to be an uncomfortable fabric component to use for garments or apparel due to its stiffness.

Fabrics consisting of cotton and/or synthetic fibers are known in the art, as described by U.S. Pat. Nos. 4,900,613 (Green), 5,223,334 (Green), 4,941,884 (Green), 5,077,126 (Green), 5,918,319 (Baxter) and 5,628,172 (Kolmes et al.).

Industrial fabrics containing Kevlar® are described in U.S. Pat. No. 5,025,537 (Green), which discloses denim fabric containing a high shrinkage staple fiber. However, the Greene patent discloses fabric having a very high tightness factor and is directed towards industrial protective apparel rather than casual garments or fabrics designed for daily use. Such industrial clothing lacks the comfort necessary for conventional attire.

In a prior publication, namely U.S. Pat. No. 5,625,537 (Green), it is known to manufacture a denim twill employing cotton, poly(p-phenylene terephthalate) (PPD-T) and nylon as shown in Example 1 of that patent. However the example is directed to a fabric which lies outside the scope of the present invention, e.g., the PPD-T is only present in the warp direction.

There is a need within the industry to provide a fabric having a high degree of strength and a high level of performance in order to address the demands required for daily use, while also retaining the necessary amount of comfort and the present invention fulfills this industry need. The present invention incorporates the strength of the high strength fiber into a fabric, without compromising the original comfort of the fabric itself. Still further, the present invention addresses those problems in manufacturing processes that improperly incorporate the fibers or yarn into the fabric, which deny the fabric the proper levels of durability, strength and comfort.

BRIEF SUMMARY OF THE INVENTION

The present invention relates to a durable denim fabric comprising a yarn having an intimate blend of cotton and high strength fibers or comprising a yarn having a sheath/core configuration comprising a natural fiber, preferably cotton, sheath and a high strength fiber core. The fabric or yarn comprises at most about 30% of a high strength fiber and a corresponding portion of a natural fiber.

More particularly, the present invention relates to a denim fabric suitable for leisure wear comprising:

(a) warp yarns comprising:
  (i) 75 to 98 parts by weight of a natural fiber, preferably cotton, and
  (ii) 2 to 25 parts by weight of a high strength fiber, preferably a para-aramid, and (b) fill yarns comprising
  (i) 75 to 98 parts by weight of a natural fiber, preferably cotton, and
  (ii) 2 to 25 parts by weight of a high strength fiber, preferably a para-aramid, wherein the fabric has at least a 15% lighter weight and at least a 15% higher tear strength and at least a 15% higher breaking strength than standard denim, however a fabric having at least a 20% lighter weight, at least a 20% higher tear strength and at least a 20% higher breaking strength is preferred.

The present invention may optionally further include about 1–5% by weight of a conductive fiber or filament wherein the conductive fiber or filament comprises carbon black or its equivalent dispersed within it, which provides the anti-static conductance to the fiber.

The present invention relates to articles of clothing made from yarns comprising natural fibers and high strength fibers, such that the high strength fiber is in both the warp and fill directions, wherein the articles of clothing include pants, shirts, jackets and the like.

DETAILED DESCRIPTION OF THE INVENTION

The present invention provides several advantages over other currently manufactured denims. Due to its construction, the present invention allows for the retention of the desirable properties of denim while also providing a lightweight garment for daily use as well as other applications. Another advantage conferred by the present invention is its versatility. The present invention, due to properties such as drape ability, allows clothing designers as well as other fabric consumers (e.g. the public) and/or designers (e.g. furniture designers or interior decorators) greater versatility where the denim may be used in a manner to which the designers and consumers were previously unaccustomed because of its heavier weight.

The present invention relates to a fabric having a looser weave, which along with a lower weight, provides a high degree of comfort and increased levels of tear and breaking strength, which are attributes not seen in the art. The fabrics of the present invention may be knitted, woven or the like.

The fibers of the present invention can be spun staple yarns produced by a number of different spinning methods that are well known within the art, including but not limited to, ring spinning, open end spinning, air jet spinning and friction spinning.

The term "lightweight denim fabric", as used herein, for example with regard to pants refers to a denim fabric that is up to approximately 11 ounces per square yard (373 grams per square meter) when compared to standard natural denim in the range of 13.5–15 ounces per square yard (460–510 grams per square meter), however, since different types of garments such as shirts employ denims of different weights, "lightweight denim fabric" also refers to denim fabric article that is at least 15% lighter than a similar article made from standard natural denim in the range of 6–8 ounces per square yard (200–270 grams per square meter).

As used herein, the term "high strength fibers" means fibers having a tenacity of at least 10 grams per dtex and a tensile modulus of at least 150 grams per dtex.

By "aramid" is meant a polyamide wherein at least 85% of the amide (—CO—NH—) linkages are attached directly to two aromatic rings. Examples of aramid fibers are described in Man-Made Fibers—Science and Technology, Volume 2, Section titled Fiber-Forming Aromatic Polyamides, page 297, W. Black et al., Interscience Publishers, 1968. Aramid fibers are, also, disclosed in U.S. Pat. Nos. 4,172,938; 3,869,429; 3,819,587; 3,673,143; 3,354,127; and 3,094,511.

A requirement of the present invention is an ability to withstand a higher degree of abrasion compared to a typical 100% cotton denim fabric of equal fabric weight. Abrasion resistance is important in certain types of clothing associated with daily use such as, for example, children's jeans where a higher degree of abrasion occurs in rough and tumble play. Jeans made of 100% cotton can develop holes quickly and must be repaired or discarded. The increased ability to resist abrasion generally denotes that an article of clothing has greater durability and therefore a longer useful lifespan before it must be discarded.

The present invention relates to a lightweight durable denim fabric comprising a natural fiber, preferably cotton, and a high strength fiber, preferably a para-aramid, and the yarns made therefrom in the manufacture of fabric having at least a 15% lighter weight and at least a 15% higher durability than standard natural denim when assessing the tear strength and the breaking strength of the denim, however a fabric having at least a 20% lighter weight, at least a 20% higher tear strength and at least a 20% higher breaking strength is preferred.

Preferably, the durable denim fabric comprises a yarn having an intimate blend of natural fiber, preferably cotton, and the high strength fibers or a sheath/core configuration comprising a natural fiber, preferably cotton, sheath and a high strength fiber core, preferably a para-aramid. The fabric comprises at most about 30% of a high strength fiber, however a range of about 5% to about 20% is preferred, and the natural fiber comprises a corresponding portion of the denim fabric. The high strength and natural fibers are distributed in both the warp and fill directions, thereby resulting in the fabric having an increased strength and looser weave construction which allows for a reduction in the fabric weight and an increased level of comfort.

More particularly, the present invention further relates to a denim fabric suitable for leisure wear comprising:

(a) warp yarns comprising:
  (i) 75 to 98 parts by weight of a natural fiber, preferably cotton, and
  (ii) 2 to 25 parts by weight of a high strength fiber, preferably a para-aramid, and
(b) fill yarns comprising
  (i) 75 to 98 parts by weight of a natural fiber, preferably cotton, and
  (ii) 2 to 25 parts by weight of a high strength fiber, preferably a para-aramid, wherein the fabric has at least a 15% lighter weight and at least a 15% higher tear strength and at least a 15% higher breaking strength than standard natural denim, however a fabric having at least a 20% lighter weight, at least a 20% higher tear strength and at least a 20% higher breaking strength is preferred.

The amount of high strength fiber will vary dependent on the specific type of high strength fiber used and the final use of the article of clothing.

Illustratively, a shirt may need less strength than pants. The cotton content can be present in an amount of 90 to 98 parts by weight and the high strength fiber in an amount of 2 to 10 parts by weight.

Examples of high strength fibers and yarns include, but are not limited to, those yarns from fibers such as aramids and particularly para-aramids, wholly aromatic copolyamides, polyolefins, polybenzoxazole, polybenzothiazole, combinations thereof, and the like, and may be made from mixtures of such yarns.

Para-aramids are common polymers in aramid yarn and poly(p-phenylene terephthalamide)(PPD-T) is a common para-aramid. By PPD-T is meant the homopolymer resulting from mole-for-mole polymerization of p-phenylene diamine and terephthaloyl chloride and, also, copolymers resulting from incorporation of small amounts of other diamines with the p-phenylene diamine and of small amounts of other diacid chlorides with the terephthaloyl chloride. As a general rule, other diamines and other diacid chlorides can be used in amounts up to as much as 10 mole percent of the p-phenylene diamine or the terephthaloyl chloride, or perhaps slightly higher, provided only that the other diamines and diacid chlorides have no reactive groups which interfere with the polymerization reaction. PPD-T, also, means copolymers resulting from incorporation of other aromatic diamines and other aromatic diacid chlorides such as, for example, 2,6-naphthaloyl chloride or chloro- or dichloroterephthaloyl chloride or 3,4'-diaminodiphenylether. For the purposes of this invention, para-aramid also includes highly modified wholly aromatic copolyamides such as copoly(p-phenylene/3,4'-diphenyl ether terephthalamide).

By "polyolefin" is meant polyethylene or polypropylene. By polyethylene is meant a predominantly linear polyethylene material of preferably more than one million molecular weight that may contain minor amounts of chain branching or comonomers not exceeding 5 modifying units per 100 main chain carbon atoms, and that may also contain admixed therewith not more than 50 weight percent of one or more polymeric additives such as alkene-1-polymers, in particular low density polyethylene, propylene, and the like, or low molecular weight additives such as anti-oxidants, lubricants, ultra-violet screening agents, colorants and the like which are commonly incorporated. Such is commonly known as extended chain polyethylene (ECPE). Similarly, polypropylene is a predominantly linear polypropylene material of preferably more than one million molecular weight. High molecular weight linear polyolefin fibers are commercially available.

Polybenzoxazole and polybenzothiazole are preferably made up of polymers of the following structures:

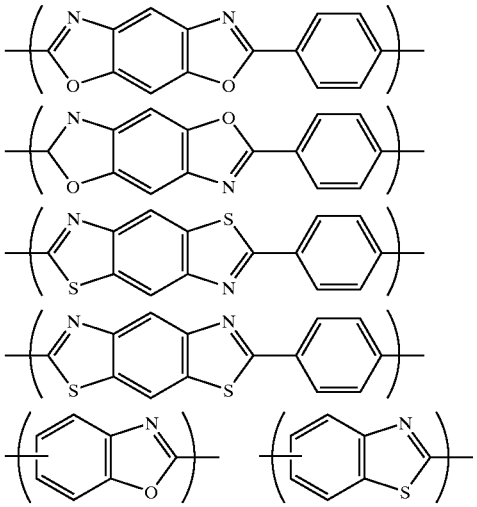

While the aromatic groups shown joined to the nitrogen atoms may be heterocyclic, they are preferably carbocyclic; and while they may be fused or unfused polycyclic systems, they are preferably single six-membered rings. While the group shown in the main chain of the bis-azoles is the preferred para-phenylene group, that group may be replaced by any divalent organic group which does not interfere with preparation of the polymer, or no group at all. For example, that group may be aliphatic up to twelve carbon atoms, tolylene, biphenylene, bis-phenylene ether, and the like.

Suitable examples of natural fibers include, but are not limited to, cotton, rayon, and other cellulosic fibers and mixtures of these fibers.

Unexpectedly, the increase in both tear strength and breaking strength were dramatic, when compared to a one hundred (100%) percent cotton denim fabric and those denim fabrics known in the art that utilize Kevlar® in the fill direction only, as is shown in Table 1 of the Examples.

An embodiment of the present invention relates to a lightweight durable denim having a weight of less than about 11 ounces per square yard (373 grams per square meter) and comprises high strength (preferably para-aramid) fibers and natural (preferably cotton) fibers, thereby forming an appropriate fabric. The denim fabric, in order to provide the requisite level of comfort, durability and strength, should comprise a cotton content of at least about 70%, more preferably at least about 80%, and up to about 30% of a high strength fiber, however a range of about 5% to about 20% is preferred; wherein the high strength fiber, preferably a para-aramid fiber and more preferably Kevlar®, is distributed in both the warp and fill directions.

The fabric may be comprised of a yarn having an intimate blend or sheath/core configuration. The high strength fiber core may be monofilament or a bundle of fibers. Further, the bundle of fibers in the high strength fiber core may be continuous filament or a plurality of staple fibers, wherein the plurality of staple fibers have a length in the range of at least about 1.12 inches (2.8 centimeters), however a range of about 1.25 inches (3.2 centimeters) to about 10 inches (25 centimeters) is preferred.

Spun yarns used for denim fabrics of the present invention are typically produced from conventional cotton system, short staple spinning processes. These processes take staple fibers, which are opened and formed into a sliver using a carding machine. A carding machine is commonly used in the fiber industry to separate, align, and deliver fibers into a continuous strand of loosely assembled fibers without twist, commonly known as carded sliver.

The carded sliver is processed into drawn sliver, typically by, but not limited to a two-step drawing process. Intimate staple fiber blends are achieved by blending staple fibers prior to carding or achieved by blending carded slivers prior to drawing. Staple fiber blending prior to carding is the preferred method for making well-mixed, homogeneous, intimate-blended spun yarns.

To make intimate blended spun yarns, drawn sliver is then made into a roving and then typically formed into a twisted yarn using any common method for making spun yarns, e.g. ring-spinning. To make core spun yarns, the drawn sliver is made into a roving and a core material is inserted with the drawn/drafted roving prior to the last draft roll in the spinning step (also referred to as a "cot"). The combined roving and core end is then co-twisted into a yarn. A guide can be used to control the insertion of the core yarn into the center of one or more drawn/drafted roving ends. Alternatively, the sliver may be spun directly to a yarn, using for example an open-end spinning machine, and example of which is a Murata jet air spinner or core-spinning machine an example of which is a DREF friction spinner.

There is no limitation on the types or size of yarns that may be made according to the process of the invention. However, this process is especially suited for providing staple yarns having a singles yarn count of 8.5 numbers metric (about an English cotton count of 5) or finer, and preferably yarns having a singles yarn count of 8.5 to 34 numbers metric (about 5 to 20 English cotton count). These single yarns can be also combined to form plied yarns.

Another embodiment of the present invention optionally further comprises about 1–5% by weight of a conductive fiber or filament rendered as such by the processes described in U.S. Pat. No. 4,612,150 (De Howitt) and U.S. Pat. No. 3,803,453 (Hull) wherein the conductive fiber comprises a fiber wherein carbon black or its equivalent are dispersed within it, which provides the anti-static conductance to the fiber. Integration of anti-static fibers into the present invention provides the denim with an anti-static quality such that the denim will have reduced static propensity, and therefore, resist the attachment of pet-hair, dust, allergens and other foreign objects typically drawn by a static charge.

The denim fabric of the present invention may contain fibers in addition to cotton or para-aramid. Conventionally these fibers are a synthetic fiber such as polyamide, e.g. nylon, nylon 6,6 and/or polyester, e.g., polyethylene terephthalate. An example of the additional fiber content of the synthetic fiber in the fabric can be 2 to 10 parts by weight and more preferably 3 to 8 parts by weight. It is understood that for the above fibers that the relative amounts in the concentration of fibers may vary in the warp and fill. Illustratively a clothing designer for marketing purposes may impart a softer tactile response solely on one fabric surface compared to the other surface.

The present invention relates to articles of clothing made from yarns comprising natural fibers and high strength fibers, such that the high strength fiber is in both the warp and fill directions, wherein the articles of clothing include pants, shirts, jackets and the like.

The embodiments of the present invention are further defined in the following Examples. It should be understood that these Examples, while indicating preferred embodiments and the most preferred embodiments of the present invention, are given by way of illustration only. From the above discussion and these Examples, one skilled in the art can ascertain the essential characteristics of this invention, and without departing from the spirit and scope thereof, can make various changes and modifications of the invention to adapt it to various uses and conditions. Thus various modifications of the present invention in addition to those shown and described herein will be apparent to those skilled in the art from the foregoing description. Although the invention has been described with reference to materials and embodiments, it is to be understood that the invention is not limited to the particulars disclosed, and extends to all equivalents within the scope of the claims.

The disclosure of each reference set forth herein is incorporated herein by reference in its entirety.

EXAMPLES

In the following Examples, all parts are by weights and degrees are shown in centigrade unless otherwise indicated.

The breaking and tear strengths were measured according to ASTM D5034 and ASTM D1424, respectively, for the fabrics of the Examples. Breaking and tear strengths are indicative of the durability of a particular fabric.

Manufacture of the sheath/core yarn samples and fabric made therefrom

Two 6.8 kilogram (15 pound) samples were prepared with the following composition:

Example 1 a. Middling grade cotton sheath material—75% by weight b. 50 numbers metric (30/1 s English cotton count), 1.7 dtex per filament (1.5 dpf) Kevlar® cotton system ring spun yarn core material—25% by weight.

Example 2 a. Middling grade cotton sheath material—75% by weight b. 50 numbers metric (30/1 s English cotton count), 1.7 dtex per filament (1.5 dpf) Kevlar® stretch broken yarn core material—25% by weight.

The cotton was spun into 1.4 numbers metric (0.80 hank) roving using conventional short staple ring spinning equipment. The cotton staple was carded into carded sliver using a CMC stationary flat top card. The carded cotton sliver was processed using two pass drawing (breaker/finisher drawing) into drawn cotton sliver using a Saco Lowell Versamatic/Shaw Drafting System 4 Over 5. The drawn cotton sliver was then processed into 1.4 nM (0.8 hank) cotton roving on a Saco Lowell 1/B/F/B Roving Frame.

To make the core spun yarn, two ends of 1.4 nM (0.8 hank) cotton roving were double creeled on a Roberts Arrow Spinning Frame with 50 mm (2 inch) ring. During the process of drawing/drafting the cotton roving, a 50 numbers metric (30/1 s cc) para-aramid spun yarn (from Example 1, then Example 2) was center inserted between the two drawn 1.4 nM (0.80 hank) cotton roving ends prior to the last draft roll (also referred to as a "cot"). The combined drawn cotton roving ends and para-aramid spun yarn end was then co-twisted into a staple spun yarn on the same Roberts Arrow Spinning Frame with 50 mm (2 inch) ring. A guide was used to control the insertion of the 50 nM (30/1 s cc) para-aramid spun yarn in the center of the two drawn roving ends. A 121 twist multiplier (turns per meter/$(nM)^{1/2}$) (or 4.0 twist multiplier in English cotton count system (turns per inch/$(cc)^{1/2}$)) was used for the 13 numbers metric (7.5/1 cc) core-spun yarn.

Example 3

The 13 numbers metric (7.5 cotton count) staple spun yarn from Example 1 was used as the warp and the filling yarn to weave denim fabric on a shuttle loom. The fabric was a 2×1, right-hand twill weave with a construction of 25.2 ends/cm and 13.4 picks/cm on loom. The greige fabric has a basis weight of 353 g/m$^2$. The tear and breaking strength values for the embodiment of the present invention described in Example 3 were much greater than those observed for 100% cotton denim having a basis weight of 492 g/m$^2$. More particularly, the breaking strength of Example 3 was about 96% greater in the warp direction and about 20% greater in the fill direction than those corresponding values for the 39% heavier weight cotton denim fabric. Similarly, the tear strength of Example 3 was about 306% greater in the warp direction and about 236% greater in the fill direction than those corresponding values for the heavier weight denim fabric. Therefore, the durability of the fabric of Example 3 is at least 15% greater than that of a standard heavier weight cotton denim fabric.

Example 4

The 13 numbers metric (7.5 cotton count) staple spun yarn from Example 2 was used as the warp and the filling yarn to weave denim fabric on a shuttle loom. The fabric was a 2×1, right-hand twill weave with a construction of 25.2 ends/cm and 13.4 picks/cm on loom. The greige fabric has a basis weight of 363 g/m$^2$. The tear and breaking strength values for the embodiment of the present invention described in Example 4 were much greater than those observed for 100% cotton denim having a basis weight of 492 g/m$^2$. More particularly, the breaking strength of Example 4 was about 125% greater in the warp direction and about 57% greater in the fill direction than those corresponding values for the 39% heavier weight cotton denim fabric. Similarly, the tear strength of Example 4 was about 277% greater in the warp direction and about 341% greater in the fill direction than those corresponding values for the heavier weight denim fabric. Therefore, the durability of the fabric of Example 4 is at least 15% greater than that of a standard heavier weight cotton denim fabric.

Comparative Examples

Comparative Example 5 was a standard, heavy weight denim fabric comprising 100% cotton and it was used as the baseline material for the breaking and tear strength to which the other fabrics were compared. The fabric was a 3×1, right-hand twill weave with a construction of 23.6 ends/cm and 16 picks/cm. The fabric has a basis weight of 492 g/m$^2$. Both the breaking strength and the tear strength for Comparative Example 5 were typical of standard, heavy weight denims.

Comparison of Fabrics

TABLE 1

| | Fabric wt. g/m$^2$ (oz/yd$^2$) | Breaking Strength Warp * Fill Newtons (lbf) | Tear Strength Warp * Fill Newtons (lbf) |
|---|---|---|---|
| Example 3 (25% Kevlar ® core and 75% cotton sheath configuration) | 353 (10.4) | 1660 × 747 (374 × 168) | 252 × 195 (56.7 × 43.8) |
| Example 4 (25% stretch-broken Kevlar ® and 75% cotton sheath configuration) | 363 (10.7) | 1900 × 979 (427 × 220) | 234 × 256 (52.5 × 57.6) |
| Comparative Example 5 | 492 (14.5) | 845 × 620 (190 × 140) | 62 × 58 (14 × 13) |

Manufacture of the intimate blend yarn samples and fabric made therefrom

Two 11.4 kilogram (25 lb) samples were prepared of the following composition:

Spun Yarn Example 6 a. Middling grade carded cotton—70% by weight b. Recycled para-aramid ballistic fabric—12.5% by weight c. 1.7 dtex per filament (1.5 dpf)×3.8 cm (1.5") para-aramid staple—12.5% by weight d. 4.3 dtex per filament (3.9 dpf)×3.8 cm (1.5") nylon/carbon sheath/core anti-static fiber—5% by weight Spun Yarn Example 7 a. Middling grade carded cotton—55% by weight b. 2.0 dtex per filament (1.8 dpf)×3.8 cm (1.5") nylon staple—15% by eight c. Recycled para-aramid ballistic fabric—12.5% by weight d. 1.7 dtex per filament (1.5 dpf)×3.8 cm (1.5") para-aramid staple—12.5% by weight e. 4.3 dtex per filament (3.9 dpf)×3.8 cm (1.5") nylon/carbon sheath/core anti-static fiber—5% by weight Note: In Examples 6 and 7, the para-aramid was poly p(phenylene terephthalamide).

The 11.4 kilogram (25 lb) staple samples were first hand mixed and fed twice through a Kitson/Saco Lowell Picker to uniformize the blend of different fibers. Once blended, each sample was fed through a Double Lickerin Roll/Single Cylinder Davis Furber Roller top Card, with comb take-off, to make carded sliver. The roller top carding system is preferred to a flat top carding system. This process enabled the separation of the cut 100% aramid ballistic fabric pieces and other blended staple fibers into a sliver comprised of separated filaments.

The above carding process used to separate the cut 100% aramid ballistic fabric pieces is preferred to feeding the 100% aramid ballistic fabric pieces to the card individually, then hand mixing. Without blending the card is not as effective in separating the fabric pieces into separate filaments.

The carded sliver was spun into staple yarn using conventional short staple ring spinning. The carded sliver was processed using two pass drawing (breaker/finisher drawing) into drawn sliver using a Saco Lowell Versamatic/Shaw Drafting System 4 Over 5. The drawn sliver was then processed into roving on a Saco Lowell 1/B/F/B Roving Frame. The roving was then processed into an 14 numbers metric (8 cc) staple spun yarn on a Roberts Arrow Spinning Frame with 5 cm (2 inch) ring. A 121 twist multiplier (turns per meter/$(nM)^{1/2}$) (or 4.0 twist multiplier in English cotton count system (turns per inch/$(cc)^{1/2}$)) was used for the spun yarn.

Since typical average cotton staple lengths range from 2.9 cm to 3.5 cm (1⅛ inch to 1⅜ inch), using aramid fibers with similar length was considered the best drafting results and spun yarn weight uniformity (also referred to as yarn evenness).

Cotton system ring spinning was selected to give the best draft uniformity of the aramid with cotton.

Weaving Example 8

The 14 numbers metric (8 cotton count) staple spun yarn from Spun Yarn Example 6 was used as filling yarn to weave denim fabric on a conventional Tsudakoma Model 209 air-jet loom. The warp yarn was consisted of two types of spun yarn in approximately end-on-end design. The first type was a 16 numbers metric (9.5 c. c.) ring-spun yarn of 84 wt. % cotton and 16 wt. % virgin para-aramid staple of 3.8 centimeter length. The second type was a 16 numbers metric (9.5 c. c.) ring-spun yarn of 84 wt. % cotton and 16 wt. % polyester staple of 3.8 centimeter length. The fabric was a 3×1 right-hand twill weave with a construction of 23.6 ends/cm and 15.7 picks/cm on loom. The fabric was sanforized in a conventional process and the sanforized fabric has a basis weight of 354 g/$m^2$.

Weaving Example 9

The same process was repeated as in weaving Example 8 with the exception of the filling yarn being 100% ring-spun cotton yarn of 14 numbers metric (8 cotton count). The sanforized fabric has a basis weight of 370 g/$m^2$.

Weaving Example 10

The same process was repeated as in Weaving Example 8 with the exception of the filling yarn being a 14 numbers metric (8 c. c.) ring-spun yarn of 75 wt. % cotton and 25 wt. % black-color virgin para-aramid staple of 3.8 centimeter length. The sanforized fabric has a basis weight of 366 g/$m^2$.

Testing

Two critical tests were conducted on the fabric samples, particularly in the filling yarn direction, to determine the fabric properties. The fabric breaking strength was measured per ASTM D 5034 "Standard Test Method for Breaking Strength and Elongation of Textile Fabrics (Grab Test)". The fabric tearing strength was measured per ASTM D 1424 "Standard Test Method for Tearing Strength of Fabrics by Falling-Pendulum Type (Elmendorf) Apparatus". Separately, the fabric electrostatic charge decay was tested per Federal Standard 191A Method 5931 "Determination of Electrostatic Decay of Fabrics". The samples were conditioned and tested at 21° C. and 20% relative humidity.

The following represents a summary of test results of fabric from Weaving Examples 8 and 10 compared to Weaving Example 9 made of 100% cotton.

Test Results

| Fabric Sample | Composition of Filling Yarn | Fabric Breaking Strength in Fill Direction (Newton) | Fabric Tearing Strength in Fill Direction (Newton) | Time to Static Decay in Fill Direction(s) |
|---|---|---|---|---|
| Weaving Example 8 | 70 wt % cotton 12.5 wt. % recycled para-aramid, 12.5 wt. % virgin para-aramid, 5 wt. % anti-static fiber | 761 | 134 | 0.01 |
| Weaving Example 10 | 75 wt. % cotton, 25 wt. % virgin para-aramid | 743 | 145 | 0.25 |
| Weaving Example 9 | 100% cotton | 560 | 62 | 0.34 |

What is claimed is:

1. A lightweight durable denim fabric comprising:

(a) warp yarns comprising:

(i) 75 to 98 parts by weight of a natural fiber, and (ii) 2 to 25 parts by weight of a high strength fiber, and (b) fill yarns comprising:

(i) 75 to 98 parts by weight of a natural fiber, and (ii) 2 to 25 parts by weight of a high strength fiber, and wherein the natural fiber is cotton and the high strength fiber is selected from the group consisting of aramid, polybenzoxazoles, and polybenzothiazoles and combinations thereof, wherein the fabric has at least at 15% lighter weight and at least a 15% higher tear strength and at least a 15% higher breaking strength than standard substantially natural denim.

2. The lightweight durable denim fabric of claim 1, wherein said natural fiber is cotton and said high strength fiber is a para-aramid.

3. The lightweight durable denim fabric of claim 2, wherein the para-aramid is poly(p-phenylene terephthalamide).

4. The lightweight durable denim of claim 2, wherein the para-aramid is copoly(p-phenylene/3,4'-diphenyl ether terephthalamide).

5. The lightweight durable denim of claim 1, wherein the high strength fiber is selected from the group consisting of polybenzoxazoles, and polybenzothiazoles and combinations thereof.

6. The lightweight denim fabric according to claim 1, wherein the fabric is made from a yarn comprising an intimate blend of fibers.

7. The lightweight denim fabric according to claim 1, wherein the fabric comprises a sheath/core or corespun yarn.

8. The lightweight durable denim fabric of claim 7, wherein said core comprises a monofilament core.

9. The lightweight durable denim fabric of claim 7, wherein said core comprises a bundle of fibers.

10. The lightweight durable denim fabric of claim 8, wherein said core comprises a continuous filament.

11. The lightweight durable denim fabric of claim 9, wherein said core comprises continuous filaments.

12. The lightweight durable denim fabric of claim 9, wherein said core comprises a plurality of staple fibers.

13. The lightweight durable denim fabric of claim 12, wherein said plurality of staple fibers have a length in the range of about 2.8 centimeters (1.12 inches) to about 25 centimeters (10 inches).

14. The lightweight denim fabric according to claim 1, wherein the fabric further comprises a conductive fiber.

15. The lightweight denim fabric according to claim 1, wherein the fabric further comprises 2 to 10 parts by weight of an additional synthetic fiber.

16. A lightweight durable denim fabric comprising a cotton content of at least about 70% and up to about 30% of a para-aramid distributed in both the warp and fill directions.

17. A shirt comprising the lightweight durable denim of claim 1.

18. A pair of pants comprising the lightweight durable denim of claim 1.

19. A method of making a lightweight durable denim comprising the steps of:

forming a fabric comprising a yarn comprising:

warp yarns comprising:

75 to 98 parts by weight of a natural fiber, and 2 to 25 parts by weight of a high strength fiber, and fill yarns comprising 75 to 98 parts by weight of a natural fiber, and 2 to 25 parts by weight of a high strength fiber;

wherein the natural fiber is cotton and the high strength fiber is selected from the group consisting of aramid, polybenzoxazoles, and polybenzothiazoles and combinations thereof, wherein the fabric has at least at 15% lighter weight and at least a 15% higher tear strength and at least a 15% higher breaking strength than standard substantially natural denim.

* * * * *